US005337550A

United States Patent [19]

Mayer et al.

[11] Patent Number: 5,337,550

[45] Date of Patent: Aug. 16, 1994

[54] METHOD AND DEVICE FOR STOPPING A SPOOL ON AN OPEN-END SPINNING MACHINE

[75] Inventors: Walter Mayer, Ingolstadt; Sebastian Brandl, Böhmfeld; Josef Neumeyer, Ingolstadt, all of Fed. Rep. of Germany

[73] Assignee: Rieter Ingolstadt Spinnereimaschinenbau AG, Ingolstadt, Fed. Rep. of Germany

[21] Appl. No.: 947,265

[22] Filed: Sep. 18, 1992

[30] Foreign Application Priority Data

Sep. 19, 1991 [DE] Fed. Rep. of Germany ..... 4131179

[51] Int. Cl.[5] ..... D01H 13/26; D01H 9/10

[52] U.S. Cl. ..... 57/263; 57/264; 57/78; 57/268; 242/37 R

[58] Field of Search ..... 57/263, 264, 270, 281, 57/78, 100; 242/35.5 R, 35.6 R, 37

[56] References Cited

U.S. PATENT DOCUMENTS

| | | | |
|---|---|---|---|
| 1,801,378 | 4/1931 | Swanson | 242/37 R |
| 2,177,457 | 10/1939 | Martindell | 242/37 R |
| 2,208,930 | 7/1940 | Kahlisch | 242/35.6 R |
| 4,137,700 | 2/1979 | Münker | 242/35.5 R X |
| 4,195,790 | 4/1980 | Reiners et al. | 242/37 R |
| 4,541,235 | 9/1985 | Raasch | 57/263 |
| 4,628,685 | 12/1986 | Stahlecker et al. | 57/263 |
| 4,644,742 | 2/1987 | Lovas et al. | 57/263 |
| 4,672,802 | 6/1987 | Raasch | 57/263 |
| 4,736,898 | 4/1988 | Raasch et al. | 242/35.5 R X |
| 5,016,830 | 5/1991 | Wey | 242/35.5 R X |
| 5,022,222 | 6/1991 | Rupert et al. | 57/263 |
| 5,159,804 | 11/1992 | Schippers et al. | 57/263 X |
| 5,170,953 | 12/1992 | Stahlecker | 242/35.5 R |

*Primary Examiner*—Daniel P. Stodola
*Assistant Examiner*—Michael R. Mansen
*Attorney, Agent, or Firm*—Dority & Manning

[57] ABSTRACT

A method of stopping a spool which is driven by a continuously rotating spool roller on an open-end spinning machine. The spool is lifted off the spool roller and a braking roller is placed on the peripheral surface of the spool, after which the braking roller is braked to a stop. In this case, the roller is driven substantially at the peripheral speed of the spool roller before being placed on the spool. In order to perform the method, the braking roller has associated with it a braking device which is connected for control purposes to a spool-changing device. The braking device is constructed as a direct-current machine with a resetter.

27 Claims, 1 Drawing Sheet

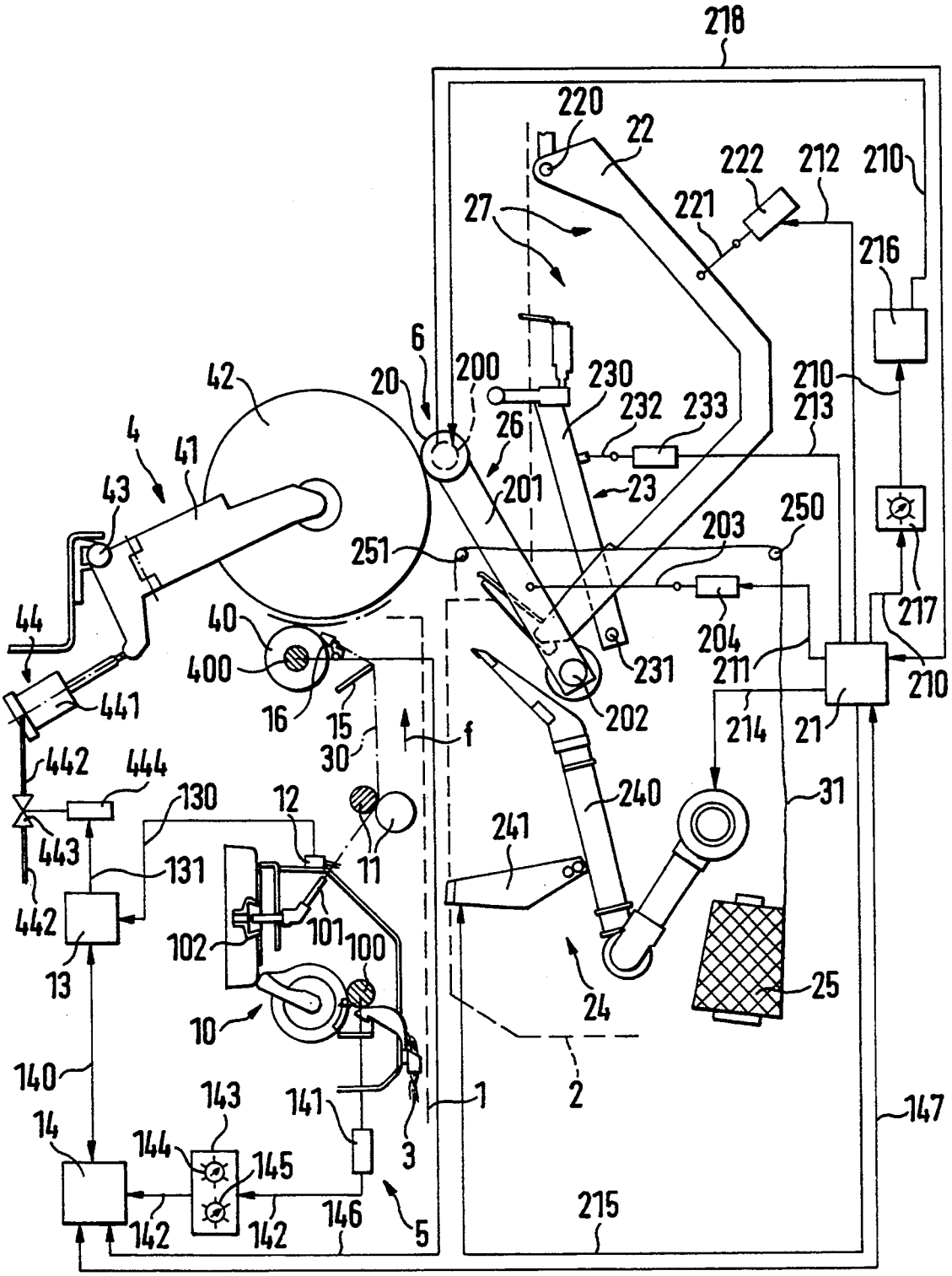
218
220
22
222
212
210
221
27
216
6
200
230
210
42
20
232
233
213
26
4
41
201
23
43
250
203
251
217
44
40
204
231
211
210
400
441
16
15
202
21
214
f
30
442
444
240
31
130
12
241
443
11
131
442
101
102
100
25
13
24
10
140
143
141
1
2
147
14
144
145
3
142
142
146
5
215

METHOD AND DEVICE FOR STOPPING A SPOOL ON AN OPEN-END SPINNING MACHINE

BACKGROUND OF THE INVENTION

The present invention relates to a method of stopping a spool which is driven by a continuously rotating spool roller on an open-end spinning machine with the spool being lifted off the spool roller for stopping. The invention also relates to a device for performing the method.

In order to stop a cross-wound spool driven by a continuously rotating spool roller, it is known to move a lifting element suddenly between the spool roller and the cross-wound spool when a thread breakage occurs (See U.S. Pat. No. 4,644,742). In this way, the cross-wound spool is separated from its drive and, in addition, is stopped by the lifting element. However, this lifting element constructed in the form of a plate damages the surface of the cross-wound spool and damages, to a certain extent, the thread wound up onto the cross-wound spool, which is undesired since this leads to drawbacks during further processing.

SUMMARY OF THE INVENTION

The object of the present invention is, therefore, to provide a method and a device, with the aid of which a spool can be rapidly stopped while the yarn is handled in a gentle manner.

This object is attained according to the invention in that the spool, constructed in the form of a cross-wound spool, is lifted off the spool roller for stopping and a roll is placed on the peripheral surface of the spool, after which the roll is braked to a stop. In this way, the spool is not acted upon violently, but is braked gently, so that the subsequent further processing is not adversely affected.

In principle, the spool can be lifted off with the aid of the braking roll which is later to effect the braking of the spool. In this case, however, the respective weight of the spool always has an effect, thus resulting in different braking times. In order to prevent this, the spool is lifted off the spool roller independently of positioning the braking roll. In this way it is made possible for the roll to be pressed against the spool lifted off the spool roller by a spool-lifting device and fixed in a defined position, so that a uniform contact pressure is present between the roll and the spool. In this way, defined braking ratios are provided.

In order to keep the stress on the spool as low as possible, in accordance with an embodiment of the process according to the invention it is provided that the roll is driven substantially at the peripheral speed of the spool roller before being placed on the spool. The roll and the spool thus have the same peripheral speed at the moment of positioning the roll, so that the winding of the spool is treated in the gentlest possible manner.

It is possible for the braking roll to be braked in various ways, but an electrical braking of the roll has been found to be particularly advantageous.

As a rule the spool is lifted off the spool roller by controlling a valve. In order to prevent the drive action of the spool roller and the braking action of the roll being exerted simultaneously upon the spool and its winding in the event of a malfunction and thereby damaging the packing, in accordance with a preferred further development of the process according to the invention the spool is monitored during the braking and the braking procedure is interrupted if the spool has not come to a stop within a certain period. In this case, a fault signal is emitted when the braking procedure is interrupted.

During the braking of the spool it is preferable to generate an electrical parameter, which is proportional to the peripheral speed of the spool, which is monitored, and which, where appropriate, is also used for interrupting the braking procedure. In this case the electrical parameter generated is preferably a voltage.

In order to avoid faulty attempts on the spool in question, in accordance with another embodiment of the process according to the invention a fault signal is generated if the spool does not come to a stop within the pre-determined period. In addition, a spool change is advantageously initiated as a function of the spool coming to a stop.

If a spool-changing device which is movable along a plurality of similar spools driven by spool rollers is used for performing the spool change, it is particularly advantageous if the lifting of the spool off the spool roller for performing a spool change is initiated either on reaching a pre-determined thread length wound up onto the spool, in addition to a fixed tolerance thread length or, on the other hand, at the latest on reaching the pre-determined thread length wound up onto the spool by controlling the movable spool-changing device. In this case it can be advantageous for the lifting of the spool by controlling the spool-changing device to take place not on reaching the predetermined thread length wound up onto the spool, but, where appropriate, even somewhat earlier, in order to prevent stoppage periods. According to the invention, in such a case, the lifting of the spool by controlling the spool-changing device takes place at the earliest on reaching the pre-determined thread length wound up onto the spool, minus the fixed tolerance thread length.

Although in principle the tolerance thread length can be fixed beforehand, it is particularly advantageous if this tolerance thread length is adjustable. It is advantageously set in such a way that it amounts to not more than 0.5% of the pre-determined thread length wound up onto the spool.

In order to perform this method according to the invention the roll has associated with it a braking device which is connected for control purposes to a spool-changing device. If the spool-changing device is to perform a spool change and the spool has not yet been lifted off the spool roller and been stopped, a rapid stopping of the spool can be achieved by the design, according to the invention, of this device, so as to avoid loss of time, which would otherwise be necessary while waiting for the spool to stop on its own. If, on the other hand, the procedure continues without waiting for the spool to stop, an ejector would have to engage the peripheral surface of the rotating spool when performing the spool change, and this could lead to damage to the cross winding of the spool.

The spool-changing device is arranged on a maintenance device which is movable along a plurality of similar spools driven by spool rollers and which also supports the braking roll. It is, therefore, not necessary to provide a separate spool-changing device and/or a separate braking roll for each of the spool arranged adjacent to one another.

Since it is necessary for the spools to be driven independently of the spool roller during piecing, it is particularly advantageous for the braking roll to have associated with it a drive device which is connected for control purposes to a piecing device. In this way the braking roll can, on the one hand, stop the spool and, on the other hand, drive the spools in both drive directions, so that with the aid thereof the thread can be delivered back to a spinning element during piecing and can be drawn off from the spinning element after piecing has been carried out.

In principle, the braking device can be made in various ways, for example mechanical. In order to prevent the occurrence of heavy wear, which is particularly great when large spools are produced, it is advantageous for the braking device to be made electric. Here, too, various designs are possible, but a design of the electric braking device as a direct-current machine with a resetter has been found to be particularly advantageous. This direct—current machine with a resetter can, therefore, operate both as a drive motor and as a brake for the roll.

In order to prevent damage to the cross winding of the spool during non-functioning of a valve which controls the spool-lifting device, it is particularly advantageous for a timing device to be associated with the braking device. In this way the braking device can be switched off after a pre-determined period so as to prevent damage to the spool.

In order to be able to perform an intended spool change particularly rapidly, in an expedient embodiment of the invention it is provided that the spool has associated with it an overspeed monitor can be brought up to the spool and can be placed on a maintenance device which is movable along a plurality of similar spools driven by spool rollers. In this way, a separate overspeed monitor is not necessary for each spool.

In principle, the overspeed monitor can be constructed in various ways, for example as a centrifugal monitor, etc. Preferably, however, the overspeed monitor is constructed as a measurement appliance of an electrical quantity produced by the direct-current machine, a design of the measurement appliance as a voltage monitor being particularly advantageous.

In order to be able to perform the spool change within certain tolerance thread lengths, according to a preferred embodiment of the invention a thread-length measuring means is provided which is connected for control purposes to the spool-lifting device. In this case, the thread-length measuring means can comprise at least one setting device, so that a specific thread length to be wound up onto the spool and a desired tolerance thread length can be set beforehand.

The braking device with its overspeed monitor is connected to a fault-signal transmitter, in order to be able to emit a fault signal for the operator in the event of braking not occurring or not occurring in a trouble-free manner.

According to a particularly advantageous embodiment of the invention the roll of the braking device is at the same time a component part of the spool-changing device, the piecing device, and a fault-signal transmitter.

The device according to the invention is simple in design and can be fitted without difficulty even afterwards, since only minor interference with the open-end spinning device and a maintenance device—possibly provided—are necessary in order to apply the method. A considerable improvement in the spool surface and, thus also in the thread wound up onto these spools, is achieved, since violent action upon the cross winding is avoided during the stoppage of the spool. On the other hand, the device according to the invention operates very economically in terms of time, since it is unnecessary to wait until a spool separated from its drive has come to a stop by running down by itself, which can last for up to three minutes or even longer depending upon the diameter and the mass of the spool.

BRIEF DESCRIPTION OF THE DRAWING

An embodiment of the invention is explained below with reference to the drawing, in which the single FIGURE is a diagrammatic cross-section view through an open-end spinning device and a maintenance device according to the invention.

DETAILED DESCRIPTION OF THE INVENTION

Only those part necessary for comprehension have been shown in the drawing. These parts are as a rule divided between a spinning machine 1 and a maintenance device 2 movable along the spinning machine 1, but it is also possible to provide all the components shown on the spinning machine 1 itself and to dispense with the maintenance device 2, in particular in the case of testing machines with a single spinning station or with only a few spinning stations.

The spinning machine 1 shown comprises a plurality of adjacently arranged spinning stations, of which however only a single spinning station is illustrated in the drawing. One open-end spinning device 10 of conventional design, to which a staple sliver 3 is supplied with the aid of a feed roller 100, is provided for each spinning station. The open-end spinning device 10 comprises a spinning element 102, for example, in the form of a spinning rotor, on the fibre-collecting surface of which the fibres accumulate, before they are spun into the end of a thread 30. The thread 30 leaves the open-end spinning device 10 through a thread draw-off tube 101, while drawing off takes place through the thread draw-off tube 101 by a pair of draw-off rollers 11. A thread monitor 12 is arranged in the thread path between the thread draw-off tube 101 and the pair of draw-off rollers 11 or alternatively after the pair of draw-off rollers 11 in the direction of the thread path (arrow f).

A spooling device 4, which essentially comprises a spool drive roller 40 driven by means of a drive 400 for driving a spool 42, held so as to be interchangeable between two pivotable spool arms 41, is provided for winding up the thread 30 drawn off from the open-end spinning device 10. The spool arms 41 are pivotable about an axis 43.

A spool-lifting device 44, comprising a drive in the form of a cylinder 441 to which a suitable control fluid can be supplied by way of a line 442, engages the spooling device 4. A control valve 443, with which drive 444 is associated, is arranged in the line 442 in order to control the control fluid. A means for emptying the cylinder 441 is also provided in a suitable manner (not shown), for example in that the control valve 443 can be connected accordingly with the aid of its drive 444 to an emptying or exhaust line.

The thread monitor 12 and the drive 444 of the control valve 443 are connected for control purposes to a spinning-station control device 13 (by operative connecting lines 130 and 131). The spinning-station control device 13 is connected, in turn, to a central control device 14 of the spinning machine 1 by way of an operative connecting line 140.

A conventional thread-tension compensating device 15 and a conventional traversing thread guide 16 for the variable displacement of the thread 30 to be wound up on the spool 42 to be formed as a cross-wound spool are arranged in the thread path between the pair of draw-off rollers 11 and the spooling device 4.

The feed roller 100 has a sensor 141 associated with it, which detects the rotational speed of the feed roller 100. This sensor 141 is connected to the control device 14 by means of an operative connecting line 142 with the interposition of a setting device 143 which in the embodiment illustrated comprises two setting elements 144 and 145. In this case the setting element 144 is used for setting a thread length at which a spool change should take place, while the setting element 145 is used for setting a tolerance thread length by which the spool change may vary with respect to the (nominal) thread length set. Together, with the setting device 143, the sensor 141 forms a thread-length measuring means 5 which is connected for control purposes to the spool-lifting device 44 by way of the control devices 14 and 13.

The control device 14 is connected to the drive 400 of the spool roller 40 by means of an operative connecting line 146.

All the devices required for performing a spool change and for the subsequent piecing are arranged on the maintenance device 2, but for sake of clarity only the units absolutely necessary for understanding the invention have been shown in the drawing.

These devices necessary for comprehension include a roller 20 which can be driven by means of a drive 200 optionally in one or the other direction. The roller 20 has a braking device 26 associated with it, which can be formed by the drive 200, for example, in the form of a direct-current machine, which can be switched from the driving mode into the braking mode.

The roller 20, with its drive 200, is arranged at the end of a pivot arm 201 which can be pivoted about a pivot axis 202. For this purpose, a coupling member 203, which can be pivoted in a reciprocating manner with the aid of a drive element 204, for example a pneumatic or hydraulic piston, is pivotably connected to the pivot arm 201. In this way, the roller 20 can be placed on the spool 42 or on an empty bobbin (not shown) or can be lifted thereof.

Both the drive 200 and the drive element 204 are connected for control purposes to a control device 21 mounted on the maintenance device 2 (by operative connecting lines 210, 218 and 211). A resetting means 216 and a time-control device 217 are arranged in the operative connecting line 210 of the drive 200 constructed in the form of a direct-current machine.

In addition, a spool-changing device 27, which essentially comprises a spool ejector 22 and a bobbin-supply device 23, is arranged on the maintenance device 2.

The spool ejector 22 is pivotable about a pivot axis 220 and is connected by means of a coupling member 221 to a drive element 222 which is constructed, for example, in the form of a cylinder and which is, in turn, connected to the control device 21 by way of an operative connecting line 212.

In addition, the bobbin-supply device 23 mentioned above, which comprises at least one pivot arm 230 pivotable about an axis 231, is provided for inserting an empty bobbin in the spooling device 4. For this purpose, a coupling member 232, which is connected to a drive element 233 which, in turn, is connected for control purposes to the control device 21 by means of an operative connecting line 213, is pivotably connected to the pivot arm 230, of which there is at least one.

Since the common control device 21 has connected to it both the drive 200 by means of the operative connecting line 210 and the spool ejector 22 and the bobbin-supply device 23 by means of the operative connecting lines 212 and 213, the braking device 26 (drive 200) is also connected for control purposes to the spool-changing device 27.

Since the control devices 14 and 21 are connected to each other for control purposes, the thread-length measuring means 5 is also connected for control purposes to the spool-changing device 27.

In addition, a piecing device 24 is arranged on the maintenance device 2; only a thread-seeking nozzle 240 and a pivotable thread-supply means 241 which are connected to the control device 21 by means of operative connecting lines 214 and 215 are illustrated as the most important parts of the piecing device 24.

Furthermore, an auxiliary spool 25 is arranged on the maintenance device 2. An auxiliary thread 31 is brought from the said auxiliary spool 25 by way of reversing rollers 250 and 251 as far as the vicinity of the opening of the thread-seeking nozzle 240. The necessary conveying and separating means have not been shown in the illustration, since these means can be constructed in a conventional manner.

The control devices 14 and 21 are connected to each other for control purposes by way of an operative connecting line 147.

Since the design of the preferred embodiment of an open-end spinning device 10 and the movable maintenance device 2 cooperating therewith has been described, the mode of operation will now be described:

During the normal production the sliver 3 is supplied to the open-end spinning device 10 with the aid of the feed roller 100, is unravelled into individual fibres in the open-end spinning device 10 in a conventional manner and is momentarily deposited in the spinning element 102, in order then to be tied into the end of the thread 30 being drawn off. Thread 30 is drawn off through the thread draw-off tube 101 from the open-end spinning device 10 by means of the pair of draw-off rollers 11 and, with the aid of the transversing thread guide 16, is placed variably on the spool 42 which, during production, is supported on the rotating spool roller 40 and is driven thereby.

Before the start of operation of the open-end spinning device 10 the nominal thread length, which is to be wound onto the spool 42, is set in the setting device 143 with the aid of the setting element 144. In addition, the tolerance thread length, by which divergence is permitted from the prescribed nominal thread length is set with the aid of the setting element 145, in order to prevent prolonged stoppage periods of the respective open-end spinning device 10, as will be described in greater detail below.

When the prescribed nominal thread length has been reached at the respective open-end spinning device 10, in accordance with the previous customary method, the open-end spinning device 10 is stopped while the supply of the sliver 3 to the open-end spinning device 10 is interrupted. In this way a thread breakage occurs, so that the thread monitor 12 responds and causes the spool 42 to be lifted off the spool roller 40 by way of the spinning-station control device 13 and the spool-lifting device 44. In this way the spool 42 is separated from its drive and slows down, but on account of the inertia of the spool 42 a long time elapses, possibly several minutes, until the spool 42 finally comes to a stop.

The spinning station, at which a spool change is to take place, is this normally brought to a stop if the maintenance device 2 coincidentally moves past the respective spinning station during its normal maintenance movement or moves to the spinning station on account of a demand triggered by the stoppage of the sliver supply to the open-end spinning device 10 and stops there, in order to perform the required spool change.

The maintenance period, until the maintenance carriage 2 reaches the spinning station at which a spool change is to be performed, can become relatively long under certain circumstances and thus cause correspondingly long production stoppages. For this reason a tolerance thread length, by which divergence is possible from the nominal thread length, is inserted into the setting device 143 by means of the setting element 145. If the maintenance device 2, moving along the open-end spinning machine 1, arrives at an open-end spinning device 10 at which the nominal thread length at the spool 42 is reached but the permissible tolerance thread length is not yet exceeded, the maintenance device 2 is stopped at the open-end spinning device 10 in question, which is performed by means which are customary and therefore not shown.

On account of reaching the nominal thread length (while taking into consideration a possible pre-determined tolerance thread length) the maintenance device 2 now produces a thread breakage which causes the spool 42 to be lifted off the spool roller 40 by way of the thread monitor 12 and the spool-lifting device 44. On account of its inertia, however, the spool 42 rotates further and thus gradually loses speed, until it finally comes to a stop.

If a spool change had already occurred with the spool not yet stopped, the effect of the spool ejector 22 upon the rotating spool surface could result in damage to the upper coils of the cross winding, which could lead to further damage and is, therefore, to be avoided when placing the spool on a spool conveyor belt afterwards and when subsequently conveying the spool thereon to a spool-collection station. If, on the other hand, there is a delay while waiting for the full spool 42 to stop, a long period of time is lost. The drive 200 of the roller 20, constructed as a braking device is, therefore, moved into its braking position, which is carried out by reversing the resetting means 216. The spool 42 is thus braked until it stops.

By tolerating the pre-determined tolerance thread lengths the maintenance device 2 can perform a spool change many times during its normal sensing movement, so that waiting times are substantially eliminated.

Even if the maintenance device 2 coincidentally reaches an open-end spinning device 10 at the moment of its stoppage on account of the nominal thread length being reached or on account of a thread breakage occurring, following a corresponding signal produced by the maintenance device 2 the spool 42 is lifted off the spool roller 40 and is braked with the aid of the braking device 26 until it stops.

In this case the movable maintenance device 2 which causes the spool 42 to be lifted off the spool roller 40 in this way can be in the form of a combined spool-changing and piecing device or even an independent spool-changing device. In the latter case a separate maintenance device which includes a piecing device 24 can be provided in addition to the maintenance device which includes the spool-changing device 27.

The spool change is now carried out, by the roller 20 being lifted off the spool 42 and being actuated from the control device 21 by way of the operative connecting line 212 and the drive element 222 of the spool ejector 22 which ejects the full spool 42 from the spooling device 4 and places it on a conveyor belt (not shown) which supplies the spool 42 to the above-mentioned spool-collection station. The ejection of the full spool 42 treats the cross winding thereof in a gentle manner, since the spool 42 is not longer rotating at this moment.

Following the ejection of the full spool 42 the bobbin-supply device 23 is pivoted by the control device 21 by way of the operative connecting line 213, and the bobbin-supply device 23 now inserts an empty bobbin between the spool arms 41 of the spooling device 4 in conventional manner. The spooling device 4 is now ready for a new piecing procedure.

During, but at the latest after, the spool change has taken place, the piecing procedure begins. In this case the spinning element 102 is cleaned in a known manner. In addition, the auxiliary thread 31, extending as far as the vicinity of the thread-seeking nozzle 240, is taken up by the thread-seeking nozzle 240, while it is drawn off in a known manner from the auxiliary spool 25 and supplied to the thread-seeking nozzle 240. After a sufficiently long piece of thread 31 has been sucked in by means of the thread-seeking nozzle 240 is moved into a position such that the auxiliary thread 31 can emerge from the thread-seeking nozzle 240 from a longitudinal slot facing the spinning machine 1 and arrives at the pivoting area of the thread-supply means 241. The latter is now pivoted and takes up the auxiliary thread 31 which is now put into a defined length and into a defined shape by means not shown. The thread end is then brought in front of the opening of the thread draw-off tube 101 and is brought back into a stand-by position inside the latter. In this case a thread reserve is formed in the path of the auxiliary thread 31 in a manner not shown.

The fibre supply is now released again into the open-end spinning device 10. In synchronism therewith the thread reserve is also released, so that the thread end reaches the fibre-collecting surface of the spinning element 102 and is joined to the fibres present there. When this has taken place, the thread which has now been newly produced is separated from the auxiliary thread 31 in a manner known per se and is transported and transferred to the empty bobbin in the spooling device 4. During this time the empty bobbin is driven by means of the roller 20 which has meanwhile been placed on the empty bobbin, until the empty bobbin brought to rest against the spool roller 40 after the transfer of the new thread to the empty bobbin has taken place. The roller 20 is now lifted off the empty bobbin. Piecing stops and the thread is wound up in conventional manner onto the spool 42 now being formed.

Even in the event of piecing without a preliminary change of spools the procedure takes place similarly. If a thread breakage occurs, the thread monitor 12 causes the spool 42 to be lifted off the spool roller 40 by way of the spinning-station control device 13 and the spool-lifting device 44. The spool 42 therefore slows to a stop, which requires some time on account of its inertia. When the maintenance device 2 reaches the respective open-end spinning device 10 during this running-down period of the spool 42, the roller 20 is brought to rest against the spool 42 and is braked. The spool 42 is thus stopped very rapidly.

Piecing now takes place in a similar manner, as described above in conjunction with a spool change. The difference lies solely in the fact that by turning the spool 42 back, the thread end is taken up by the surface of the spool 42 by means of the thread-seeking nozzle 240 and is delivered back to the open-end spinning device 10 for piecing and the thread end of an auxiliary thread 31 drawn off from an auxiliary spool 25 is not used for piecing. Then the thread draw-off is initiated by driving the spool 42 in the wind-up direction.

In principle, the spool change is performed precisely when a pre-determined thread length wound up onto the spool 42 is achieved. In this case it has to be accepted, however, that the spinning station in question is possible stopped for a relatively long time, since depending upon the position occupied by the maintenance device 2 at the moment of reaching the nominal thread length it may be a long time before the maintenance device arrives back at this spinning station during its sensing path or on account of a fault message.

The process described above, in which it is accepted that a certain tolerance thread length exists by which there may be a divergence from the pre-determined thread length, is, therefore, considerably more efficient. In this case the spinning station in question is not stopped immediately when the pre-determined thread length is reached, but only when the said thread length is exceeded by the tolerance thread length set. Stopping then takes place in the manner described by producing a thread breakage which then, in turn, causes the spool 42 to be lifted off the spool roller 40.

If, however, the maintenance device 2 has reached the spinning station in questions, when the pre-determined thread length to be wound up onto the spool 42 has been reached or even exceeded (but without the additional tolerance thread length being reached, which would in any case cause this spinning station to stop) the maintenance device 2 emits a signal which, in a manner which is known and therefore not described in greater detail, produces a thread breakage at this spinning station and thus causes the spool 42 to be lifted off the spool roller 40.

Depending upon the setting, such a lifting of the spool 42 from the spool roller 40 can be initiated not just on reaching the nominal thread length but as soon as a nominal thread length less than a pre-determined tolerance thread length is reached.

The tolerance thread length, by which the nominal thread length may be exceeded and possibly also not reached, can be pre-determined as being fixed, for example, by the setting device 143. It is also possible, however, (as described above) for a setting element 145 to be provided with the aid of which the tolerance thread length can be pre-determined in meters or in percentages. In this case the tolerance thread length should not be chosen too long. An order of magnitude of 0.5% of the nominal thread length to be wound onto the spool 42 has been found to be practicable as an acceptable excess length.

Where appropriate, two setting elements can also be provided instead of a single setting element 145 for setting tolerance thread lengths, one of the setting elements establishing the tolerance thread length by which the nominal thread length is not reached, while the other of the setting elements establishes the tolerance thread length by which the nominal thread length may be exceeded. The two tolerance thread lengths can be equal or of different size, it is possible also for one or both tolerance thread lengths to have the value of zero. If the two setting elements for the tolerance thread lengths are set at zero, a spool change takes place when the precise pre-determined nominal thread length is reached.

A particularity gentle treatment of the full spool 42 is achieved when the roller 20 is brought to the peripheral speed of the spool roller 40 before being placed on the full spool 42 by being controlled by means of the control device 21 of the maintenance device 2 by way of the operative connecting line 210. In this case the necessary data are transmitted from the control device 14 of the spinning machine 1 by way of the operative connecting line 147 to the control device 21 and thence to the drive 200 of the roller 20. Only after the roller 20 has been brought to the same peripheral speed as the spool roller 40 and thus the spool 42, does the control device 21 cause the roller 20 to be placed on the peripheral surface of the spool 42 by way of the operative connecting line 211 and the drive element 232 and cause the spool 42 to be braked to a standstill.

In principle, the spool 42 can have its own roller 20 independent of the piecing device 24 for stopping it. In the case of the embodiment illustrated, however, a separate braking roller has been omitted. In fact, the roller 20, which causes the spool 42 to be braked, is connected to a drive 200 which is connected for control purposes by way of the operative connecting line 210 to the control device 21 of the maintenance carriage 2 which controls the piecing process.

As described, the roller 20 is not only part of the piecing device 24 and the spool-changing device 27, but in addition, also a part of the braking device 26 and a fault-signal transmitter, as further described below.

The drive 200 can likewise be constructed in any desired manner. If a direct-current motor is used it can be switched from driving mode to braking mode with the aid of a resetting means 216.

If faults in the spool-lifting device 44, in particular of the valve 441, result in the spool 42 not being lifted off the spool roller 40, this would adversely affect the cross winding if both the spool roller 40 and the roller 20 were to act upon the spool surface simultaneously for a prolonged period. In order to prevent this, the spool 42 is monitored during the braking procedure.

If a direct-current machine is used as the drive 200, an electrical parameter, for example a voltage, is generated in the direct-current machine, for example, by the roller 20 resting on the spool 42 and is passed on to the control device 21 by way of the operative connecting line 218. If no reduction in this electrical parameter, for example voltage, is set, after a pre-determined time the roller 20 is stopped and is lifted off the spool 42. In addition, the control device 21 has the effect that this braking procedure is not repeated but a fault signal is generated so that an operator can check the source of the fault. The roller 20 is thus (as described above) part of a fault-signal transmitter.

The above-mentioned pre-determined time until the roller 20 stops can, for example, be programmed into the control device 21. In accordance with the embodiment shown, the time allowance is made with the aid of the time-control device 217.

In this way, in the embodiment described, the drive 200 forms an overspeed monitor 6. In principle, the monitoring of the speed of the roller 20 (or another roller resting on the spool 42 and comprising a braking device 26) or of the spool 42 can take place in any way desired with the aid of different overspeed monitors 6, for example, by counting pulses which are generated by such a roller (for example, the roller 20) or the spool 42 during its rotation. If an electrical parameter is produced, depending upon the design of the overspeed monitor 6 sensing the rotational speed of the spool 42 directly or indirectly this electrical parameter can also be the strength of current. In addition, in a direct-current machine which acts as the overspeed monitor 6, the electrical parameter can, where appropriate, be a change in the position of the magnetic field.

In the case of the design described, a measuring appliance acts as the overspeed monitor 6 for measuring the electrical quantity produced by the direct-current machine (the drive 200) an depending upon the rotational speed of the spool 42. If the induced voltage is measured, the measuring appliance is in the form of a voltage monitor which in the embodiment illustrated is an integral component part of the control device 21 and is, therefore, not shown separately.

The above-mentioned fault signal, which, if desired, can be emitted if the spool 42 is not stopped, has the advantage that further attempts are avoided from the start, so that the time spent is reduced. In addition, the risk of possible damage to units of the maintenance device 2 and of the open-end spinning device 10 is reduced. The fault signal causes, for example, a fault-signal transmitter to respond, for example, a signal lamp to light up or an acoustic signal transmitter to respond, so that the operator of the spinning machine 1 can search for the source of the fault and can rectify it.

The overspeed monitor 6 (pulse counter, measuring appliance etc.) is connected for control purposes to the spool-changing device 27 by way of the operative connecting lines 210 and 212, 213 and the control device 21. In this way, it is possible for the overspeed monitor 6 to generate by way of the control device 21 not only a fault signal but also a start signal for performing the spool change. The spool change can thus be initiated by the stoppage of the spool 42 before or at the latest on reaching the period pre-determined for the braking procedure. Such an initiation of the spool-changing procedure can, if desired, also be used if the provision of a braking period is omitted. In the latter case the braking action is discontinued, and the achievement of the spool stoppage is signalled.

An overspeed monitor 6 can be associated with the spool 42 in a stationary manner at each spinning station. It can also, however, be arranged on the maintenance device 2 and can be moved to the spool 42 for performing the spool change and/or the piecing procedure.

The method explained and the method described can thus be applied in various ways, for example by individual features being substituted by equivalents or being used in other combinations. It is, therefore, of secondary importance whether the roller 20 is already positioned on the spool 42 before the latter has been lifted off the spool roller 40, or whether this positioning of the roller 20 takes place at the moment of lifting off the spool or only, as described above, after the spool has been lifted off. The sequence can be selected freely. It is merely necessary to ensure that the braking action is started only after the full spool 42 has been lifted off the spool roller 40, so that the spool 42 is not subjected to the driving action of the spool roller 40 and the braking action of the roller 20 simultaneously.

The same purpose is also served by the described method of bringing the roller 20 to the peripheral speed of the full spool 42 before it is positioned on the latter, so that the roller 20 need not first be accelerated by the spool 42 before the braking action is started.

In the embodiment described the braking of the spool 42 takes place electrically by means of a reversible direct-current machine (the drive 200), but it is also possible to use an eddy-current brake or the like or even a mechanical brake as the braking device 26.

In the case of the embodiment described the spool change is initiated upon reaching a pre-determined thread length (taking into consideration a fixed tolerance thread length). In principle, this thread length can be fixed beforehand or, as shown, can be set by means of at least one setting element 144.

Instead of one thread length, however, the spool diameter can also be used to initiate the spool change, the spool diameter being detected by a light barrier (not shown) which is adjustable and which is associated with the spool 42 and signals the achievement of a pre-determined diameter to the spinning-station control device 13 and to the control device 14, which then, in turn, signals this to the control device 21 on the maintenance device 2.

We claim:

1. A method of stopping a spool driven by contact with a continuously rotating spool drive roller, comprising the following steps:

a) lifting said spool off said drive roller to move said spool out of driving contact with said drive roller;

b) bringing the peripheral surface of said spool into contact with a braking roll as said spool is still rotating;

c) applying a braking force to said braking roll to stop said braking roll and said spool; and d) driving said braking roll at a peripheral speed which is substantially the same as that of said spool prior to applying the braking force to said braking roll.

2. A method of stopping a spool as set forth in claim 1, wherein said step of lifting said spool is effected independently of positioning the braking roll at any time prior to said applying a braking force to said braking roll.

3. A method of stopping a spool as set forth in claim 1, including the step of driving said braking roll at a peripheral speed which is substantially the same as that of said spool driving roller prior to said bringing said spool into contact with said braking roll.

4. A method of stopping a spool as set forth in claim 1, including the step of braking said braking roll with an electrical braking device.

5. A method of stopping a spool as set forth in claim 4, including the steps of generating a measurable electrical parameter with said electrical braking device during said braking which is proportional to the peripheral speed of said spool and monitoring said parameter.

6. A method of stopping spool as set forth in claim 5, including the step of generating a voltage as said electrical parameter.

7. A method of stopping a spool as set forth in claim 1, including the steps of monitoring said spool during said braking process and interrupting said braking process if said spool does not stop within a predetermined period of time.

8. A method of stopping a spool as set forth in claim 7, including the step of emitting a fault signal when said braking process is interrupted.

9. A method of stopping a spool as set forth in claim 8, including the step of emitting a fault signal if said spool does not stop within a predetermined period of time.

10. A method of stopping a spool as set forth in claim 8, further including the step of exchanging an empty tube for said spool in dependence upon stoppage of said spool.

11. A method of stopping a spool as set forth in claim 1, including the step of monitoring during normal spinning operations the length of thread wound onto said spool, said lifting of said spool off said spool driving roller occurring once a predetermined length of thread has been wound onto said spool.

12. A method of stopping a spool as set forth in claim 11, including the step of exchanging an empty tube for said spool only after said predetermined length of thread minus a fixed tolerance length has been wound onto said spool.

13. A method of stopping a spool as set forth in claim 12, wherein said fixed tolerance thread length is adjustable.

14. A method of stopping a spool as set forth in claim 13, wherein said fixed tolerance thread length is adjusted so as to not exceed 0.5% of said predetermined thread length.

15. A device for stopping a spool onto which a thread is wound which is driven by contact with a continuously rotating spool drive roller, comprising:

a) lifting means for moving said spool out of contact with said drive roller;
b) a braking roll disposed adjacent to said spool;
c) means for brining said braking roll into peripheral contact with the peripheral surface of said spool;
d) braking means for applying a braking force to said braking roll to stop said roll and said spool;
e) means for accelerating said braking roll up to the circumferential speed of said spool before applying said braking means;
f) a thread monitor for monitoring said thread;
g) a spool changing device for exchanging an empty tube for said spool; and
h) control means connecting said spool lifting means to said thread monitor and said spool changing device for controlling the stopping and exchanging of said spool upon concurrence of a predetermined thread condition detected by said thread monitor.

16. A device for stopping a spool as set forth in claim 15, wherein a plurality of said spools are arranged one next to the other, each of the spools being driven by a continuously driven spool drive roller, wherein said spool changing device is disposed on a maintenance device which moves alongside said plurality of spools and carries said braking roll.

17. A device for stopping a spool as set forth in claim 15, including a piecing device for piecing a thread after a spool change has been effected, said piecing device including a drive means for driving said brake roll, and further including a connection provided between said braking roll and said braking means and between said braking roll and said drive means for driving said brake roll in synchronism with said piecing device for piecing of a thread.

18. A device for stopping a spool as set forth in claim 15, wherein said braking means is an electrical braking device.

19. A device for stopping a spool as set forth in claim 18, wherein said electrical braking device comprises a direct current motor operably configured within said braking roll, said motor including a re-setting device for changing the rotational direction of said motor.

20. A device for stopping a spool as set forth in claim 15, comprising a timing device operably configured with said braking means for determining the period of time during which said braking means is actuated.

21. A device for stopping a spool as set forth in claim 15, further comprising a rotational speed monitor operably configured to monitor the rotational speed of said brake roll and connected to said spool changing device for effecting a spool exchange once said spool is at a standstill.

22. A device for stopping a spool as set forth in claim 21, wherein said rotational speed monitor is disposed on a maintenance device which is movable alongside said spool.

23. A device for stopping a spool as set forth in claim 21, wherein said rotational speed monitor comprises a device for measuring an electrical quantity which is produced by said braking means in dependence upon the rotational speed of said spool with which said brake roll is in contact with when braking said spool.

24. A device for stopping a spool as set forth in claim 23, wherein said measuring device measures voltage.

25. A device for stopping a & as set forth in claim 15, further comprising a thread length measuring means connected to said control means for controlling said spool lifting means and said spool changing device upon reaching of a predetermined length of thread.

26. A device for stopping a spool as set forth in claim 25, wherein said thread length measuring means comprises a setting device for setting thread length.

27. A device for stopping a spool as set forth in claim 15, further comprising a fault-signal transmitter associated with said braking means in order to prevent further actuation of said braking means when braking of the spool cannot be effected within a predetermined period of time.

* * * * *